US010640724B2

(12) United States Patent
Strong et al.

(10) Patent No.: US 10,640,724 B2
(45) Date of Patent: May 5, 2020

(54) ADDITIVE PACKAGE AND LUBRICATING OIL COMPOSITION

(71) Applicant: Infineum International Limited, Abingdon (GB)

(72) Inventors: Anthony J. Strong, Oxford (GB); Philip J. Woodward, Berkshire (GB)

(73) Assignee: INFINEUM INTERNATIONAL LTD., Abingdon, Oxfordshire (GB)

( * ) Notice: Subject to any disclaimer, the term of this patent is extended or adjusted under 35 U.S.C. 154(b) by 182 days.

(21) Appl. No.: 15/611,842

(22) Filed: Jun. 2, 2017

(65) Prior Publication Data

US 2017/0349853 A1 Dec. 7, 2017

(30) Foreign Application Priority Data

Jun. 3, 2016 (EP) ..... 16172800

(51) Int. Cl.

| | |
|---|---|
| ***C10M 145/28*** | (2006.01) |
| ***C10M 165/00*** | (2006.01) |
| ***C10M 129/44*** | (2006.01) |
| ***C10M 129/54*** | (2006.01) |
| ***C10M 129/70*** | (2006.01) |
| ***C10M 137/10*** | (2006.01) |
| ***F01M 9/02*** | (2006.01) |

(52) U.S. Cl.

CPC ..... *C10M 145/28* (2013.01); *C10M 129/44* (2013.01); *C10M 129/54* (2013.01); *C10M 129/70* (2013.01); *C10M 137/10* (2013.01); *C10M 165/00* (2013.01); *F01M 9/02* (2013.01); *C10M 2207/128* (2013.01); *C10M 2207/262* (2013.01); *C10M 2207/281* (2013.01); *C10M 2209/104* (2013.01); *C10M 2209/109* (2013.01); *C10M 2209/112* (2013.01); *C10M 2223/045* (2013.01); *C10N 2220/021* (2013.01); *C10N 2230/04* (2013.01); *C10N 2230/06* (2013.01); *C10N 2230/10* (2013.01); *C10N 2230/12* (2013.01); *C10N 2230/18* (2013.01); *C10N 2230/52* (2013.01); *C10N 2240/10* (2013.01)

(58) Field of Classification Search

CPC ..... C10M 145/28; C10M 129/44; C10M 129/54; C10M 129/70; C10M 137/10; C10M 165/00; C10M 2207/128; C10M 2207/262; C10M 2207/281; C10M 2209/104; C10M 2223/045; C10M 2209/109; C10M 2209/112; F01M 9/02; C10N 2220/021; C10N 2230/04; C10N 2230/06; C10N 2230/10; C10N 2230/12; C10N 2230/18; C10N 2230/52; C10N 2240/10

See application file for complete search history.

(56) References Cited

U.S. PATENT DOCUMENTS

| | | | | |
|---|---|---|---|---|
| 4,203,877 | A | 5/1980 | Baker | |
| 4,354,949 | A | 10/1982 | Eggers et al. | |
| 4,776,966 | A * | 10/1988 | Baker | C09K 8/36 507/117 |
| 2011/0067662 | A1 | 3/2011 | Loper | |
| 2012/0196778 | A1* | 8/2012 | Gieselman | C10M 141/10 508/370 |
| 2015/0094245 | A1* | 4/2015 | Gieselman | C10M 145/24 508/308 |

FOREIGN PATENT DOCUMENTS

| | | | |
|---|---|---|---|
| EP | 1990400 | A2 | 11/2008 |
| WO | WO-2013/154978 | A1 | 10/2013 |

* cited by examiner

*Primary Examiner* — Cephia D Toomer

(57) ABSTRACT

An additive package is disclosed for preparing an automotive crankcase lubricating oil composition for an internal combustion engine. The additive package is made by admixing:

(i) 50 mass % or less of an oil of lubricating viscosity;
(ii) 50 mass % or less of at least one overbased metal detergent, preferably at least one overbased metal hydroxybenzoate detergent;
(iii) 50 mass % or less of an oil-soluble block or graft co-polymer of at least one polymeric block A which is derived from a hydroxycarboxylic acid and at least one polyalkylene block B which is a residue of a polyalkylene glycol, and
(iv) optionally, at least one further additive selected from a dispersant, an antioxidant and/or an antiwear agent.

The additive package includes less than 2.00 mass % preferably less than 1.50 mass %, of a friction modifier which is a monoester of a $C_5$ to $C_{30}$ carboxylic acid and which is free of nitrogen.

Component (ii) is preferably an overbased metal hydroxybenzoate detergent.

Component (iii) acts as a friction modifier and can be used as a replacement for a friction modifier such as glycerol monooleate.

The additive package exhibits improved stability.

55 Claims, No Drawings

ADDITIVE PACKAGE AND LUBRICATING OIL COMPOSITION

FIELD OF THE INVENTION

The present invention relates to an additive package and a lubricating oil composition prepared therefrom. Lubricating oil compositions, more especially automotive lubricating oil compositions for use in piston engines, especially gasoline (spark-ignited) and diesel (compression-ignited) crankcase lubrication, are referred to as crankcase lubricants.

Crankcase lubricants are prepared from additive packages including, for example, a detergent and a friction modifier. It is well-known that there are stability issues between detergents and friction modifiers in additive packages, which can lead, for example, to the production of sediment, haze or a gel. This problem can be overcome by the use of two separate additive packages: one including the detergent and another including the friction modifier. However, one single additive package is is preferred. A stable additive package should produce a stable finished. lubricating oil composition.

Furthermore, there is a drive to increase the amount of friction modifier in a lubricating oil composition in order to improve fuel economy by reducing friction. However, increasing the amount of friction modifier exacerbates the stability problem.

Friction modifiers, also referred to as friction-reducing agents, may be boundary additives that operate by lowering friction coefficient and hence improve fuel economy. The use of glycerol monoesters as friction modifiers has been described in the art, for example in U.S. Pat. Nos. 4,495,088; 4,683,069; EP-A-0 092 946; and WO-A-01/72933.

Glycerol monoester friction modifiers are used commercially. However, there is a problem with stability for additive packages that include glycerol monoester friction modifiers such as, for example, glycerol monooleate, when overbased detergents such as, for example, overbased calcium salicylate detergents, are also present.

The aim of this invention is to improve the stability of an additive package including a detergent and a friction modifier. In particular, the aim of this invention is to improve the stability of an additive package including a detergent such as an overbased metal hydroxybenzoate and a friction modifier.

The aim of this invention is to improve the stability of a lubricating oil composition including a detergent and a friction modifier. In particular, the aim of this invention is to improve the stability of a lubricating oil composition including a detergent such as an overbased metal hydroxybenzoate and a friction modifier.

SUMMARY OF THE INVENTION

The present invention meets the above problems by providing certain block or graft copolymers as friction modifiers for use in additive packages and lubricating oil compositions which include an overbased metal detergent such as, for example, an overbased metal salicylate detergent.

In accordance with a first aspect, the present invention provides an additive package for preparing an automotive crankcase lubricating oil composition for an internal combustion engine; the additive package comprising or made by admixing:

(i) 50 mass % or less of an oil of lubricating viscosity;

(ii) 50 mass % or less of at least one overbased metal detergent, preferably at least one overbased metal hydroxybenzoate detergent;

(iii) 50 mass % or less of an oil-soluble block or graft co-polymer of at least one polymeric block A which is derived from a hydroxycarboxylic acid and at least one polyalkylene block B which is a residue of a polyalkylene glycol, and (iv) optionally, at least one further additive selected from a dispersant, an antioxidant and/or antiwear agent;

wherein the additive package includes less than 2.00 mass %, preferably less than 1.50 mass %, more preferably less than 1 mass % and most preferably less than 0.5 mass %, of a friction modifier which is a monoester of a $C_5$ to $C_{30}$ carboxylic acid and which is free of nitrogen.

The additive package is preferably free or substantially free of a friction modifier which is a monoester of a $C_5$ to $C_{30}$ carboxylic acid and which is free of nitrogen. The additive package is preferably free or substantially free of a friction modifier which is a glycerol monoester such as, for example, glycerol monooleate ('GMO').

The additive package is preferably used at a treat rate of 2 to 20, more preferably 4 to 18, and even more preferably 5 to 17, mass %. To prepare a fully formulated lubricating oil composition, the additive package is mixed with the required amount of base oil and any other additional additives (i.e. to the balance of 100 mass %).

In the additive package, the oil of lubricating viscosity is present in an amount of 50 mass % or less, preferably less than 20 mass more preferably less than 15 mass and most preferably from 5 to 10 mass %, of the additive package.

In the additive package, the overbased metal detergent is present in an amount of 50 mass % or less, preferably less than 30 mass %, more preferably less than 25 mass % and most preferably from 5 to 20 mass %, of the additive package.

In the additive package, the oil-soluble block or graft co-polymer is present in an amount of 50 mass % or less, preferably less than 10 mass %, more preferably less than 5 mass %, and most preferably from 0.01 to 5 mass %, of the additive package.

In the additive package, the dispersant is preferably present in an amount greater than 30 mass %, more preferably greater than 40 mass %, even more preferably greater than 50 mass %, and most preferably from 30 to 60 mass %, of the additive package.

In the additive package, the antioxidant is preferably present in an amount less than 20 mass %, more preferably less than 10 mass %, and most preferably from 2 to 10 mass %, of the additive package.

In the additive package, the antiwear agent is preferably present in an amount less than 30 mass %, more preferably less than 20 mass %, and most preferably from 5 to 15 mass %, of the additive package.

In accordance with a second aspect, the present invention provides an automotive crankcase lubricating oil composition, for an internal combustion engine, comprising or made by admixing:

in excess of 50 mass % of an oil of lubricating viscosity;

(ii) 50 mass % or less of at least one overbased metal detergent, preferably an overbased metal hydroxybenzoate, detergent;

(iii) 50 mass % or less of an oil-soluble block or graft co-polymer of at least one block A which is derived from a hydroxycarboxylic acid and at least one polyalkylene block B which is a residue of a polyalkylene glycol, and (iv) optionally, at least one further additive selected from a dispersant, an antioxidant and/or a antiwear agent;

wherein the lubricating oil composition includes less than 0.10 mass %, preferably less than 0.05 mass more preferably less than 0.01 mass %, of a friction modifier which is a monoester of a $C_5$ to $C_{30}$ carboxylic acid and which is free of nitrogen, such as, for example, glycerol monooleate.

The lubricating oil composition is preferably free or substantially free of a friction modifier which is a monoester of a $C_5$ to $C_{30}$ carboxylic acid and which is free of nitrogen, such as, for example, glycerol monooleate.

The lubricating oil composition preferably has a total base number (TBN) of 4 to 15, preferably 5 to 12, mg KOH/g as measured by ASTM D2896.

The oil-soluble block or graft co-polymer is preferably at least one block A which is an oligo- or polyester residue of a hydroxycarboxylic acid and at least one block B which is a residue of a polyalkylene glycol.

The mono carboxylic acid in component (iii) is preferably hydroxystearic acid, more preferably 12 hydroxy stearic acid.

The polyalkylene glycol in component (iii) is preferably polyethylene glycol.

The molecular weight of the polymeric block A in component (iii) is preferably in the range 1000 to 2800, more preferably 1,500 to 2,700, and most preferably 2,000 to 2,600, as measured by Gel Permeation Chromatography (GPC).

The number average molecular weight of the polymeric block B in component (iii) is preferably in the range 500 to 4600, more preferably 1,000 to 4,400, even more preferably 1,400 to 4,200, and most preferably 1,450 to 4,100, as measured by Gel Permeation Chromatography.

The number average molecular weight of the block copolymer in component (iii) is preferably in the range 3000 to 5000, as measured by Gel Permeation Chromatography.

In this specification, all measurements of molecular weight by Gel Permeation Chromatography (GPC) are relative to linear polystyrene standards.

The block copolymer in component (iii) preferably has the structure AB or ABA, preferably ABA, where the A blocks may be the same or different.

The lubricating oil composition is preferably an automotive crankcase lubricating oil composition having TBN of less than 20 mg KOH/g, preferably 1 to 15 mg KOH/g, such as 5 to 15 mg KOH/g, as measured by ASTM D2896.

According to a third aspect, the present invention provides a method of improving the friction-reduction properties and/or storage stability of an automotive crankcase lubricating oil composition for an internal combustion engine or an additive package for preparing the same; the method comprising incorporating into the composition or the package for preparing the same, in respective amounts of 50 mass % or less, one or more additives (iii) as defined in the first aspect of the invention; the automotive crankcase lubricating oil composition or the additive package including at 50 mass % or less of at least one overbased metal detergent.

According to a fourth aspect, the present invention provides the use of component (iii), as defined in the first aspect of the invention, in an amount of 50 mass % or less as an additive in an automotive crankcase lubricating oil composition for an internal combustion engine to improve the friction reducing properties and/or storage stability of the composition, wherein the automotive crankcase lubricating oil composition includes at least one overbased metal detergent in an amount of 50 mass % or less.

In an embodiment of the fourth aspect, component (iii) is used as a replacement for a friction modifier which is glycerol monooleate.

In a fifth aspect, the present invention provides a method of lubricating an internal combustion engine during operation of the engine comprising:

(i) providing in respective amounts of 50 mass % or less, one or more components (iii) as defined in the first aspect of the invention in an amount of in excess of 50 mass % of an oil of lubricating viscosity including at least one overbased metal detergent, to make an automotive crankcase lubricant;

(ii) providing the lubricant in the combustion engine;

(iii) providing a hydrocarbon fuel in the combustion engine; and (iv) combusting the fuel in the combustion engine.

In this specification, the following words and expressions, if and when used, have the meanings ascribed below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains only hydrogen and carbon atoms and that is bonded to the remainder of the compound directly via a carbon atom;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"major amount" means in excess of 50 mass % of a composition, preferably in excess of 60 mass % of a composition, more preferably in excess of 70 mass % of a composition and most preferably in excess of 80 mass % of a composition;

"minor amount" means 50 mass % or less of a composition; preferably 40 mass % or less of a composition; more preferably 30 mass % or less of a composition and most preferably 20 mass % or less of a composition;

"TBN" means total base number as measured by ASTM D2896;

"phosphorus content" is measured by ASTM D5185;

"sulfur content" is measured by ASTM D2622;

"sulfated ash content" is measured by ASTM D874.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

Furthermore, the constituents of this invention may be isolated or be present within a mixture and remain within the scope of the invention.

DETAILED DESCRIPTION OF THE INVENTION

The features of the invention relating, where appropriate, to each and all aspects of the invention, will now be described in more detail as follows:

Oil of Lubricating Viscosity (i)

The oil of lubricating viscosity (sometimes referred to as "base stock" or "base oil") is the primary liquid constituent of a lubricant, into which additives and possibly other oils are blended, for example to produce a final lubricant (or lubricant composition). Also, a base oil is useful for making concentrates as well as for making lubricants therefrom.

A base oil may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from. distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are to known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Base oil may be categorised in Groups I to V according to the API EOLCS 1509 definition.

When the oil of lubricating viscosity is used to make a concentrate, it is present in a concentrate-forming amount (e.g., from 30 to 70, such as 40 to 60, mass %) to give a concentrate containing for example 1 to 90, such as 10 to 80, preferably 20 to 80, more preferably 20 to 70, mass % active ingredient of an additive or additives, being component (ii) above, optionally with one or more co-additives. The oil of lubricating viscosity used in a concentrate is a suitable oleaginous, typically hydrocarbon, carrier fluid, e.g. mineral lubricating oil, or other suitable solvent. Oils of lubricating viscosity such as described herein, as well as aliphatic, naphthenic, and aromatic hydrocarbons, are examples of suitable carrier fluids for concentrates.

Concentrates constitute a convenient means of handling additives before their use, as well as facilitating solution or dispersion of additives in lubricants. When preparing a lubricant that contains more than one type of additive (sometime referred to as "additive components"), each additive may be incorporated separately, each in the form of a concentrate. In many instances, however, it is convenient to provide a so-called additive "package" (also referred to as an "adpack") comprising one or more co-additives, such as described hereinafter, in a single concentrate.

The oil of lubricating viscosity may be provided in a major amount, in combination with a minor amount of additive component (ii) as defined herein and, if to necessary, one or more co-additives, such as described hereinafter, constituting a lubricant. This preparation may be accomplished by adding the additive directly to the oil or by adding it in the form of a concentrate thereof to disperse or dissolve the additive. Additives may be added to the oil by any method known to those skilled in the art, either before, at the same time as, or after addition of other additives.

Preferably, the oil of lubricating viscosity is present in the lubricant in an amount of greater than 55 mass %, more preferably greater than 60 mass even more preferably greater than 65 mass %, based on the total mass of the lubricant. Preferably, the oil of lubricating viscosity is present in an amount of less than 98 mass %, more preferably less than 95 mass %, even more preferably less than 90 mass %, based on the total mass of the lubricant.

The lubricants of the invention may he used to lubricate mechanical engine components, particularly in internal combustion engines, e.g. spark-ignited or compression-ignited two- or four-stroke reciprocating engines, by adding the lubricant thereto. Preferably, they are crankcase lubricants such as passenger car motor oils or heavy duty diesel engine lubricants.

The lubricating oil compositions of the invention comprise defined components that may or may not remain the same chemically before and after mixing with an oleaginous carrier. This invention encompasses compositions which comprise the defined components before mixing, or after mixing, or both before and after mixing.

When concentrates are used to make the lubricants, they may for example be diluted with 3 to 100, e.g. 5 to 40, parts by mass of oil of lubricating viscosity per part by mass of the concentrate.

The lubricants of the present invention may contain low levels of phosphorus, namely not greater than 1600, preferably not greater than 1200, more preferably not greater than 800, parts per million (ppm) by mass of phosphorus, expressed as atoms of phosphorus, based on the total mass of the lubricant.

Typically, the lubricants may contain low levels of sulfur. Preferably, the lubricant contains up to 0.4, more preferably up to 0.3, most preferably up to 0.2, mass sulfur, expressed as atoms of sulfur, based on the total mass of the lubricant.

Typically, the lubricant may contain low levels of sulfated ash. Preferably, the lubricant contains up to 1.0, preferably up to 0.8, mass % sulfated ash, based on the total mass of the lubricant.

Suitably, the lubricant may have a total base number (TBN) of between 4 to 15, preferably 5 to 12, such as 7 to 8.

Overbased Metal Detergent (ii)

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds.

Detergents generally comprise a polar head with a long hydrophobic tail, the polar head comprising a metal salt of an acidic organic compound. The salts may contain a substantially stoichiometric amount of the metal when they are usually described as normal or neutral salts and would typically have a total base number or TBN (as may be measured by ASTM D2896) of from 0 to 80. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN, as defined in ASTM D2896, of 150 or greater, and typically of from 250 to 500 or more, such as around 350 mg KOH/g.

Detergents that may be used include oil-soluble neutral and overbased sulfonates, phenates, sulfurized phenates, thiophosphonates, hydroxybenzoates such as salicylates, and naphthenates and other oil-soluble carboxylates of a metal, particularly the alkali or alkaline earth metals, e.g. sodium, potassium, lithium, calcium and magnesium. The most commonly-used metals are calcium and magnesium, which may both be present in detergents used in a lubricant, and mixtures of calcium and/or magnesium with sodium.

Particularly preferred metal detergents are neutral and overbased alkali or alkaline earth metal alkylsalicylates having a TBN as defined in ASTM 2896 of from 50 to 450, preferably 150 to 350, more preferably 200 to 300 mg KOH/g. Highly preferred salicylate detergents include alkaline earth metal salicylates, particularly magnesium and calcium, especially, calcium salicylates.

Additive Component (iii)

This is preferably a block or graft copolymer having a general formula $(A\text{-}COO)_2\text{-}B$, wherein each polymeric component A has a molecular weight of at least 500 and is the residue of an oil-soluble complex monocarboxylic acid having the general structural formula (I)

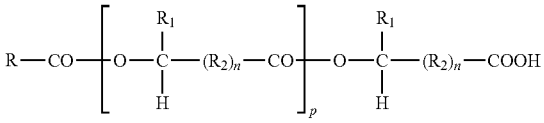

in which

R is hydrogen or a monovalent hydrocarbon or substituted hydrocarbon group;

$R_1$ is hydrogen or a monovalent $C_1$ to $C_{24}$ hydrocarbon group;

$R_2$ is a divalent $C_1$ to $C_{24}$ hydrocarbon group;

n is zero or 1, preferably 1;

p is zero or an integer up to 200;

and wherein each polymeric component B has a molecular weight of at least 500 and is the divalent residue of a water-soluble polyalkylene glycol having the general formula (II)

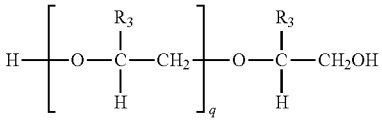

in which $R_3$ is hydrogen or a $C_1$ to $C_3$ alkyl group;

q is an integer from 10 up to 500.

The units of the formula

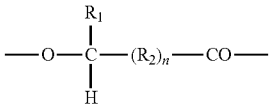

which are present in the molecule of the complex monocarboxylic acid as represented by formula I may be all the same or they may differ in respect of $R_1$, $R_2$ and n. The quantity p will not normally have the same unique value for all molecules of the complex acid but will be statistically distributed about an average value lying within the range stated, as is commonplace in polymeric materials.

Similarly, the units of formula

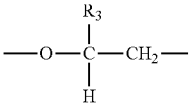

which are present in the polyalkylene glycol as represented by formula II may be all the same or they may differ in respect of $R_3$. The quantity q in formula II will normally vary statistically about an average value within the range stated, and somewhat wider variation may be deliberately introduced if desired by deriving the component B from a mixture of two or more polyalkylene glycols of differing average chain lengths. The component B may if desired be derived From a mixture of two or more different polyether polyols.

The complex monocarboxylic acid, from which the polymeric components A are derived by the notional removal of the carboxyl group, is structurally the product of interesterification of one or more monohydroxy-monocarboxylic acids together with a monocarboxylic acid free from hydroxyl groups which acts as a chain terminator. The hydrocarbon chains R, $R_1$ and $R_2$ may be linear or branched. R is preferably an alkyl group containing up to 25 carbon atoms, for example a straight chain $C_{17}H_{35}$-group derived from stearic acid. $R_1$ is preferably a straight-chain alkyl group, and $R_2$ is preferably a straight-chain alkylene group; for example, the unit containing $R_1$ and $R_2$ may be derived from 12-hydroxy-stearic acid.

The polyalkylene glycol of the formula II, from which the polymeric component B may be derived by the notional removal of the two terminal hydroxyl groups, may be, for example, a polyethylene glycol, a polypropylene glycol, a mixed polyethylene-propylene) glycol or a mixed poly(ethylene-butylene) glycol, that is to say, $R_3$ may be hydrogen or a methyl or ethyl group.

Preferably each of the polymeric components A has a molecular weight of at least 1000 as measured by Gel Permeation Chromatography (GPC) (by "molecular weight" is meant herein number average molecular weight). Thus where, for example, the group R is derived from stearic acid and the unit containing $R_1$ and $R_2$ together is derived from 12-hydroxystearic acid, p will have a value of at least 2. Similarly, it is preferred that the polymeric component B has a molecular weight of at least 1000 as measured by Gel Permeation Chromatography (GPC). Thus where that component is the residue of a polyalkylene glycol which is derived from ethylene oxide exclusively, q will preferably have a value of at least 23. Similarly, where the component B is the residue of a polyether polyol which is derived from ethylene oxide as the sole alkylene oxide, the total number of oxyethylene units in the molecule will preferably be at least 23.

In any given block or graft copolymer of the general formula hereinabove defined, the weight ratio of the combined components A to the component B may vary widely. Typically the ratio will lie in the range from 9:1 to 1:9, but weight ratios outside this range may he appropriate for certain applications of the copolymers. In A-COO-B-OOC-A block copolymers, where the component B is derived from polyethylene glycol and the components A are derived from poly (12hydroxy-stearic acid), the weight proportion of polyethylene glycol residues may be, for example, from 20% to 80%.

In an embodiment, component B constitutes at least 65% by weight of the total copolymer component (iii).

In another embodiment, component B constitutes not more than 40% by weight of the total copolymer component (iii).

The block or graft copolymers of the invention may be obtained by procedures which are well known in the art. According to one procedure, they are prepared in two stages. In the first stage, the complex monocarboxylic acid from which the Components A are to be derived is obtained by interesterification of a monohydroxy monocarboxylic acid in the presence of a non-hydroxylic monocarboxylic acid; in the second stage, this complex monocarboxylic acid is reacted with the polyalkylene glycol or polyether polyol from which the component B is to be derived, in the ratio of m molar proportions to 1 molar proportion respectively, according to the particular value of m in the case in question. The hydroxyl group in the monohydroxymonocarboxylic acid, and the carboxyl group in either carboxylic acid, may be primary, secondary or tertiary in character. Suitable hydroxycarboxylic acids for use in the first stage include glycollic acid, lactic acid, hydracrylic acid and, in particular 12-hydroxystearic acid. The non-hydroxylic carboxylic acid which acts as a chain terminator, and hence as a means of regulating the molecular weight of the complex monocarboxylic acid, may be, for example, acetic acid, propionic acid, caproic acid, stearic acid or an acid derived from a naturally occurring oil, such as tall oil fatty acid. Commercial quantities of 12-hydroxystearic acid normally contain about 15% of stearic acid as an impurity and can conveniently he used without further admixture to produce a complex acid of molecular weight about 1500-2000. Where the non-hydroxylic monocarboxylic acid is separately introduced, the proportion which is required in order to produce a complex monocarboxylic acid of a given molecular weight can be determined either by simple experiment or by calculation.

The interesterification of the monohydroxymonocarboxylic acid and the non-hydroxylic monocarboxylic acid may be effected by heating the starting materials in a suitable hydrocarbon solvent such as toluene or xylene, which is able to form an azeotrope with the water produced in the esterification reaction. The reaction is preferably carried out in an inert atmosphere, e.g. of nitrogen, at a temperature of up to 250° C., conveniently at the refluxing temperature of the solvent. Where the hydroxyl group is secondary or tertiary the temperature employed should not be so high as to lead to dehydration of the acid molecule. Catalysts for the interesterification, such as p-toluene sulphonic acid, zinc acetate, zirconium naphthenate or tetrabutyl titanate, may be included, with the object of either increasing the rate or reaction at a given temperature or of reducing the temperature required for a given rate of reaction.

In the second stage of the first procedure for obtaining the block or graft copolymers of the invention, the complex monocarboxylic acid prepared in the first stage is reacted with the polyalkylene glycol or polyether polyol from which the component B is to be derived. For each molar proportion of the glycol or polyol, there are taken m molar proportions of the acid, according to the particular value of m in the case in question. The reaction is suitably carried out under the same conditions as have been described for the first stage.

According to the second procedure for obtaining the copolymers of the invention, the two reactions described above are carried out simultaneously, that is to say, the monohydroxy-monocarboxylic acid, the non-hydroxylic monocarboxylic acid and the polyalkylene glycol or polyether polyol are all heated together, in the same proportions as would have been taken for the first procedure, in a hydrocarbon solvent at a temperature of up to 250° C., optionally in the presence of a catalyst and observing due precautions.

The copolymers obtained by the two alternative procedures, from the same starting materials and in the same proportions, appear to be very similar in composition and characteristics but, because of its simplicity and consequent greater economy, the second procedure is to be preferred.

An example of a particular block or graft copolymer according to the invention is an $(A\text{-}COO)_2$-B block copolymer in which each A component is the residue of poly (12-hydroxystearic acid) chain-terminated with stearic acid and of molecular weight approximately 1750 as measured by Gel Permeation Chromatography (GPC), and the B component is the residue of polyethylene glycol of molecular weight approximately 1500 as measured by Gel Permeation Chromatography (GPC). This copolymer thus contains 30% of polyethylene glycol residues and is soluble in hydrocarbon oils, including those low in aromatic content such as low odour kerosene, diesel oil and mineral oils.

Preferably the copolymer component (iii) has a hydrophilic/lipophilic balance (HLB) of at least 6.5, preferably in the range 7 to 9.

Suitably, the additive component (iii) is present in an amount of 0.05 to 10, preferably 0.1 to 5, more preferably 0.1 to 2, mass % of the lubricant, based on the total mass of the lubricant.

Co-Additives

Co-additives, with representative effective amounts in lubricants, that may also be present, different from additive components (ii) and (iii), are listed below. All the values listed are stated as mass % active ingredient.

| Additive | Mass % (Broad) | Mass % (Preferred) |
|---|---|---|
| Ashless Dispersant | 0.1-20 | 1-8 |
| Friction modifier | 0-5 | 0-1.5 |
| Corrosion Inhibitor | 0-5 | 0-1.5 |
| Metal dihydrocarbyl dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier (1) | 0-6 | 0.01-4 |
| Mineral or Synthetic Base Oil | Balance | Balance |

(1) Viscosity modifiers are used only in multi-graded oils.

The final lubricant, typically made by blending the or each additive into the base oil, may contain from 5 to 25, preferably 5 to 18, typically 7 to 15, mass % of the co-additives, the remainder being oil of lubricating viscosity.

The above mentioned co-additives are discussed in further detail as follows; as is known in the art, some additives can provide a multiplicity of effects, for example, a single additive may act as a dispersant and as an oxidation inhibitor.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants are usually "ashless", as mentioned above, being non-metallic organic materials that form substantially no ash on combustion, in contrast to metal-containing, and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678;-3,154,560;-3,172,892;-3,024,195;-3,024,237,-3,219,666;and -3,216,936, that may be post-treated to improve their properties, such as borated (as described in U.S. Pat. Nos. 3,087,936 and 3,254,025) fluorinated and oxylated. For example, boration may be accomplished by treating an acyl nitrogen-containing dispersant with a boron compound selected from boron oxide, boron halides, boron acids and esters of boron acids.

Friction modifiers include glycerol monoesters of higher fatty acids, for example, glycerol monooleate; esters of long chain polycarboxylic acids with dials, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

The additive package includes less than 2.00 mass %, preferably less than 1.50 mass %, of a friction modifier which is a monoester of a $C_5$ to $C_{30}$ carboxylic acid and which is free of nitrogen.

The lubricating oil composition includes less than 0.10 mass %, preferably less than 0.05 mass %, more preferably less than 0.01 wt %, of a friction modifier which is a monoester of a $C_5$ to $C_{30}$ carboxylic acid and which is free of nitrogen, such as, for example, glycerol monoester.

The additive package and the lubricating oil composition are preferably free or substantially free of a glycerol monoester friction modifier such as, for example, glycerol monooleate. Glycerol monoester friction modifiers are metal-free.

Other known friction modifiers comprise oil-soluble organo-molybdenum compounds. Such organo-molybdenum friction modifiers also provide antioxidant and antiwear credits to a lubricating oil composition. Suitable oil-soluble organo-molybdenum compounds have a molybdenum-sulfur core. As examples there may be mentioned dithiocarbamates, dithiophosphates, dithiophosphinates, xanthates, thioxanthates, sulfides, and mixtures thereof. Particularly preferred are molybdenum dithiocarbamates, dialkyldithiophosphates, alkyl xanthates and alkylthioxanthates. The molybdenum compound is dinuclear or trinuclear.

One class of preferred organo-molybdenum compounds useful in all aspects of the present invention is tri-nuclear molybdenum compounds of the formula $Mo_3S_kL_nQ_z$ and mixtures thereof wherein L are independently selected ligands having organo groups with a sufficient number of carbon atoms to render the compounds soluble or dispersible in the oil, n is from 1 to 4, k varies from 4 through to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The molybdenum compounds may be present in a lubricating oil composition at a concentration in the range 0.1 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricant. For some applications, the molybdenum is present in an amount of greater than 500 ppm.

Anti-oxidants are sometimes referred to as oxidation inhibitors; they increase the resistance of the lubricant to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically-hindered phenols, secondary aromatic amines, and organo-copper salts); hydroperoxide decomposers (e.g., organosulfur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Examples of suitable antioxidants are selected from copper-containing antioxidants, sulfur-containing antioxidants, aromatic amine-containing antioxidants, hindered phenolic antioxidants, dithiophosphates derivatives, metal thiocarbamates, and molybdenum-containing compounds.

Dihydrocarbyl dithiophosphate metals salts are frequently used as antiwear and antioxidant agents. The metal may be an alkali or alkaline earth metal, or aluminium, lead, tin, zinc molybdenum, manganese, nickel or copper. Zinc salts are most commonly used in lubricants such as in amounts of 0.1 to 10, preferably 0.2 to 2, mass %, based upon the total mass of the lubricant. They may be prepared in accordance with known techniques by first forming a dihydrocarbyl dithiophosphoric acid (DDPA), usually by reaction of one or more alcohols or a phenol with $P_2S_5$, and then neutralising the formed DDPA with a zinc compound. For example, a dithiophosphoric acid may be made by reaction with mixtures of primary and secondary alcohols. Alternatively, multiple dithiophosphoric acids can be prepared where the hydrocarbyl groups on one acid are entirely secondary in character and the hydrocarbyl groups on the other acids are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction.

Anti-wear agents reduce friction and excessive wear and are usually based on compounds containing sulfur or phosphorous or both, for example that are capable of depositing polysulfide films on the surfaces involved. Noteworthy are the dihydrocarbyl dithiophosphates, such as the zinc dialkyl dithiophosphates (ZDDP's) discussed herein.

Examples of ashless anti-wear agents include 1,2,3-triazoles, benzotriazoles, thiadiazoles, sulfurised fatty acid esters, and dithiocarbamate derivatives.

Rust and corrosion inhibitors serve to protect surfaces against rust and/or corrosion. As rust inhibitors there may be mentioned non-ionic polyoxyalkylene polyols and esters thereof, polyoxyalkylene phenols, and anionic alkyl sulfonic acids.

Pour point depressants, otherwise known as lube oil flow improvers, lower the minimum temperature at which the oil will flow or can be poured. Such additives are well known. Typical of these additive are $C_8$ $C_{18}$ dialkyl fumarate/vinyl acetate copolymers and polyalkylmethacrylates.

Additives of the polysiloxane type, for example silicone oil or polydimethyl siloxane, can provide foam control.

A small amount of a demulsifying component may be used. A preferred demulsifying component is described in EP-A-330,522. It is obtained by reacting an alkylene oxide with an adduct obtained by reaction of a bis-epoxide with a polyhydric alcohol. The demulsifier should be used at a level not exceeding 0.1 mass % active ingredient. A treat rate of 0.001 to 0.05 mass % active ingredient is convenient.

Viscosity modifiers (or viscosity index improvers) impart high and low temperature operability to a lubricant. Viscosity modifiers that also function as dispersants are also known and may be prepared as described above for ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine.

The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

EXAMPLES

The invention will now be particularly described in the following examples which we are not intended to limit the scope of the claims hereof.

Preparation of Block Co-polymer 1

A flask fitted with a distillation condenser and an overhead stirrer was charged with 73 g of polyethylene glycol with a number average molecular weight of about 1500 (PEG 1500) and 146 g of PEG 4000. The flask was heated to 85-90° C. with stirring and a nitrogen sparge to keep the reaction mixture under a flow of nitrogen. Next, 450 g of 12-hydroxystearic acid was charged to the flask. Once the 12-hydroxystearic acid had been charged 1.4 g of tetrabutyl titanate (TBT) catalyst was added. The temperature of the reaction mixture was increased to 222° C. and the acid value of the mixture was monitored every hour. Once the acid value reached 10 mg KOH/g or below, the reaction was stopped. The reaction product was a block co-polymer of polyhydroxystearate (A)-polyethyleneglycol (B) polyhydroxystearate (A). Block co-polymer 1 had an HLB of between 7 and 9.

The number average molecular weight of Block Co-polymer I was determined using Gel Permeation Chromatography (GPC) as follows.

Samples of Block Co-polymer 1 were prepared at a concentration of approximately 10 mg/ml using THF as a solvent. Approximately 100 mg of sample was dissolved in 10 ml eluent. The solution was left for 24 hours at room temperature to fully dissolve and then filtered through a 0.2 μm PTFE Filter prior to injection into the GPC column. The samples were analysed using the conditions listed below. The samples were injected using automatic sample injection. Data capture and subsequent data analysis was carried out using Viscotek's 'Omnisec' software. Each sample was injected in duplicate.

| | |
|---|---|
| Instrument | Viscotek GPC Max |
| Columns | 3 * 30 cm Plgel 100A, 1000A & 10,000 GPC columns |
| Eluent | THF + 1% TEA |
| Flow rate | 0.8 ml/min |
| Detection | RI (refractive index) |
| Temperature | 40° C. |

The GPC system was calibrated using a conventional method of calibration against a series of linear polystyrene standards. These standards covered the range from approximately 150 to 450,000 daltons. The GPC columns selected for this analysis have a linear response up to approximately 600,000 daltons.

The number average molecular weight measured as above for Block Co-polymer I was in the range 3,500 to 4,100, with an average value of about 3825.

Crankcase Lubricants

Example 1

Block Co-polymer 1 (0.5%) was blended into an oil of lubricating viscosity, consisting of YUBASE 4 (59.9%) and YUBASE 6 (18.91%), a viscosity modifier (9.60%), together with an additive package (11.09%) including overbased calcium alkyl salicylate detergent, dispersant, antiwear, antioxidant and antifoamant.

Example 2

Block Co-polymer 1 (0.25%) and a solvent neutral 100 group I base oil (0.25%) were blended into an oil of lubricating viscosity, consisting of YUBASE 4 (59.9%) and YUBASE 6 (18.91%), a viscosity modifier (9.60%), together with an additive package (11.09%) including overbased calcium alkyl salicylate detergent, dispersant, antiwear, antioxidant and antifoamant.

Comparative Example 3

The same crankcase lubricant as in Example 1 was blended but with glycerol monooleate (GMO) (0.5%) instead of Block Co-polymer 1.

Comparative Example 4

A solvent neutral 100 group I base oil (0.5%) was blended into an oil of lubricating viscosity, consisting of YUBASE 4 (59.9%) and YUBASE 6 (18.91%), a viscosity modifier (9.60%), together with an additive package (11.09%) including overbased calcium alkyl salicylate detergent, dispersant, antiwear, antioxidant and antifoamant.

Tests & Results

Friction Performance Testing

The above crankcase lubricants were tested for friction reduction using a PCS instruments high frequency reciprocating rig (HFRR) on the following profile:

| | |
|---|---|
| Contact | 6 mm Ball on 10 mm Disc |
| Load, N | 4 |

-continued

| | |
|---|---|
| Stroke/Length, mm | 1 |
| Frequency, Hz | 40 |
| Stage temperature, ° C. | 40-140 (20° C. steps, 6 stages) |
| Rubbing time/Stage, min | 5 |

Results were reported as friction coefficients, where lower values indicate superior friction reducing performance.

The results are summarized in Table 1 below.

TABLE 1

| Time (s) | 151 | 451 | 751 | 1051 | 1351 | 1751 |
|---|---|---|---|---|---|---|
| Example 1 | 0.117 | 0.126 | 0.121 | 0.112 | 0.104 | 0.099 |
| Example 2 | 0.119 | 0.123 | 0.123 | 0.116 | 0.105 | 0.097 |
| Comparative Example 3 | 0.114 | 0.120 | 0.119 | 0.121 | 0.115 | 0.113 |
| Comparative Example 4 | 0.120 | 0.122 | 0.138 | 0.147 | 0.151 | 0.150 |

The results show that at 751 s. Examples 1 and 2 (of the invention) are as good as Comparative Example 3 at reducing friction over Comparative Example 4 but subsequently, they are surprisingly better. Furthermore, Example 2 (of the invention) demonstrates that improved friction performance can be offered over Comparative Example 3 at a relatively lower mass % in the oil.

Stability Testing 100 ml of the sample to be tested was poured into a centrifuge tube and supported in an oven at 60° C. The samples were observed at the following intervals for any sign of undesirable appearance;

After 1 day;

After 4 days;

At weekly intervals until end of 12 weeks.

The centrifuge tubes were observed under both natural light and a high intensity light source. The centrifuge tubes were cleaned with solvent, if required, to ensure a clear view. A 'Fail' means that at least one of the following observations have been made:

Sediment—hard, solid particles which have collected at the very bottom of the tube;

Haze;

Suspension—suspended particles or floc, sometimes flake-like in appearance, and usually light in colour;

Gel—soft lumps which are often very small and not easily seen.

Phase Separation—materials can sometimes separate into two or more layers.

The following additive packages were prepared and tested for stability. The values listed below are in mass %.

| Components | Comparative Example 5 | Example 6 | Comparative Example 7 | Example 8 |
|---|---|---|---|---|
| GMO Friction modifier, from Infineum UK Ltd | 1.302 | | 1.282 | |
| Block Co-polymer 1 | | 1.302 | | 1.282 |
| Overbased Calcium Salicylate detergent (TBN 350 mg KOH/g) | 15.622 | 15.622 | 15.381 | 15.381 |

-continued

| Components | Comparative Example 5 | Example 6 | Comparative Example 7 | Example 8 |
|---|---|---|---|---|
| PCMO package including dispersant, antiwear, anti-oxidant and antifoamant | 74.745 | 74.745 | 75.133 | 75.133 |
| Solvent Neutral 100 Group I base stock | 8.332 | 8.332 | 8.203 | 8.203 |

Stability Results

| | Comparative Example 5 | Example 6 | Comparative Example 7 | Example 8 |
|---|---|---|---|---|
| 1 Day | Fail | Pass | Pass | Pass |
| 4 Days | Fail | Pass | Fail | Pass |
| 1 week | Fail | Pass | Fail | Pass |
| 2 weeks | Fail | Pass | Fail | Pass |
| 3 weeks | Fail | Pass | Fail | Pass |
| 4 weeks | Fail | Pass | Fail | Pass |
| 5 weeks | Fail | Pass | Fail | Pass |
| 6 weeks | Fail | Pass | Fail | Pass |
| 7 weeks | Fail | Pass | Fail | Pass |
| 8 weeks | Fail | Pass | Fail | Pass |
| 9 weeks | Fail | Pass | Fail | Pass |
| 10 weeks | Fail | Pass | Fail | Pass |
| 11 weeks | Fail | Pass | Fail | Pass |
| 12 weeks | Fail | Pass | Fail | Pass |

| Components | Comparative Example 9 | Comparative Example 10 | Example 11 |
|---|---|---|---|
| GMO friction modifier from Infineum UK Ltd | | 2.604 | |
| Block Co-polymer 1 | | | 2.604 |
| Overbased calcium salicylate (TBN 350 mg KOH/g) | 16.043 | 15.625 | 15.625 |
| PCMO package including dispersant, antiwear, antioxidant and antifoamant | 75.401 | 73.438 | 73.438 |
| Solvent Neutral 100 Group I base stock | 8.556 | 8.333 | 8.333 |

Stability Results

| | Comparative Example 9 | Comparative Example 10 | Example 11 |
|---|---|---|---|
| 1 Day | Pass | Fail | Pass |
| 4 Days | Pass | Fail | Pass |
| 1 week | Pass | Fail | Pass |
| 2 weeks | Pass | Fail | Pass |
| 3 weeks | Pass | Fail | Pass |
| 4 weeks | Pass | Fail | Pass |
| 5 weeks | Pass | Fail | Pass |
| 6 weeks | Pass | Fail | Pass |
| 7 weeks | Pass | Fail | Pass |
| 8 weeks | Pass | Fall | Pass |
| 9 weeks | Pass | Fail | Pass |
| 10 weeks | Pass | Fail | Pass |
| 11 weeks | Pass | Fail | Pass |
| 12 weeks | Pass | Fail | Pass |

The results show that an additive package including Block Co-polymer 1 is more stable than an additive package including glycerol monooleate at an equal mass %.

Therefore, not only is Block Co-polymer 1 a good friction modifier, it also produces a more stable additive package concentrate than one containing glycerol monooleate ('GMO') friction modifier.

What is claimed is:

1. A method of lubricating an automotive internal combustion engine during operation of the engine comprising:

(i) providing to a crankcase of the automotive internal combustion engine an automotive crankcase lubricating oil composition comprising or made by admixing:

(a) in excess of 50 mass % of an oil of lubricating viscosity;

(b) less than 50 mass % of at least one overbased metal detergent;

(c) less than 50 mass % of an oil-soluble block or graft co-polymer of at least one block A which is derived from a hydroxycarboxylic acid and at least one polyalkylene block B which is a residue of a polyalkylene glycol, the oil-soluble block or graft copolymer having a general formula $(A\text{-}COO)_m\text{-}B$, wherein m is 1 or 2, wherein each polymeric component A has a molecular weight of at least 500 and has the general structural formula

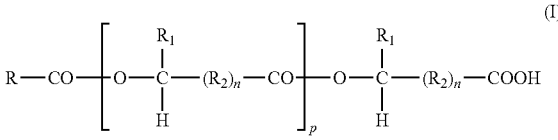

(I)

in which: R is hydrogen or a monovalent hydrocarbon or substituted hydrocarbon group;

$R_1$ is hydrogen or a monovalent $C_1$ to $C_{24}$ hydrocarbon group; $R_2$ is a divalent $C_1$ to $C_{24}$ hydrocarbon group; n is zero or 1; and p is zero or an integer up to 200; and wherein each polymeric component B has a number average molecular weight of at least 500 and has the general formula

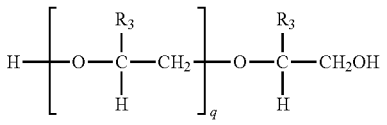

(II)

in which: $R_3$ is hydrogen or a $C_1$ to $C_3$ alkyl group; and q is an integer from 10 up to 500; and (d) optionally, at least one further additive comprising a dispersant, an antioxidant, and/or an antiwear agent, wherein the automotive crankcase lubricating oil composition includes less than 0.10 mass % of a friction modifier which is a monoester of a $C_5$ to $C_{30}$ carboxylic acid and which is free of nitrogen;

(ii) providing a hydrocarbon fuel in the automotive internal combustion engine; and (iii) combusting the fuel in the automotive internal combustion engine.

2. The method of claim 1, wherein the hydroxycarboxylic acid is a hydroxystearic acid.

3. The method of claim 1, wherein the polyalkylene glycol in component (i)(c) is polyethylene glycol.

4. The method of claim 1, wherein one or more of the following are satisfied:

the molecular weight of the polymeric block A in component (i)(c) is from 1000 to 2800 as measured by Gel Permeation Chromatography;

the number average molecular weight of the polymeric block B in component (i)(c) is from 500 to 4600 as measured by Gel Permeation Chromatography; and the number average molecular weight of the copolymer in component (i)(c) is from 3000 to 5000, as measured by Gel Permeation Chromatography.

5. The method of claim 1, wherein the copolymer in component (i)(c) has the structure AB or ABA, with the proviso that, where the block copolymer in component (i)(c) has the structure ABA, the A blocks may be the same or different.

6. The method of claim 1, wherein the friction modifier is glycerol monoester, and wherein the automotive crankcase lubricating oil composition comprising component (c) and less than 0.10 mass % of the glycerol monoester exhibits a lower friction coefficient than an otherwise identical automotive crankcase lubricating oil composition, except comprising substantially none of component (c) and more than 0.10 mass % of the glycerol monoester, when friction coefficients are measured at HFRR testing times greater than 751 seconds.

7. The method of claim 1, wherein R is an alkyl group containing up to 25 carbon atoms, $R_1$ is a straight-chain alkyl group containing 1 to 24 carbon atoms and $R_2$ is a straight-chain alkylene group containing 1 to 24 carbon atoms.

8. The method of claim 7, wherein $R_3$ is hydrogen or a $C_1$-$C_3$ alkyl group.

9. The method of claim 1, wherein the or each of the polymeric components A has a molecular weight of at least 1000 as measured by Gel Permeation Chromatography, and/or the polymeric component B has a number average molecular weight of at least 1000 as measured by Gel Permeation Chromatography.

10. The method of claim 1, wherein the or each of the polymeric components A are derived from poly(12-hydroxystearic acid) chain-terminated with stearic acid, and the polymeric component B is derived from polyethylene glycol.

11. The method of claim 1, wherein the automotive crankcase lubricating oil composition comprises not greater than 1600 ppm by mass of phosphorus, expressed as phosphorus atoms.

12. The method of claim 11, wherein the automotive crankcase lubricating oil composition comprises not greater than 800 ppm by mass of phosphorus, expressed as phosphorus atoms.

13. The method of claim 12, wherein the automotive crankcase lubricating oil composition comprises not greater than 500 ppm by mass of phosphorus, expressed as phosphorus atoms.

14. The method of claim 1, wherein the automotive crankcase lubricating oil composition has a sulfated ash content of up to 1.0 and a sulfur content of up to 0.4 mass %.

15. The method of claim 1, wherein said automotive crankcase lubricating oil composition further contains one or more other additive components, different from component (i)(c), selected from the group consisting of ashless dispersants, corrosion inhibitors, antioxidants, zinc dihydrocarbyl dithiophosphates, pour point depressants, antiwear agents, friction modifiers other than a monoester of a $C_5$ to $C_{30}$ carboxylic acid which is nitrogen-free, demulsifiers, and anti-foam agents.

16. The method of claim 1, wherein the overbased metal detergent is a metal hydroxybenzoate detergent.

17. The method of claim 16, wherein the metal hydroxybenzoate detergent is an alkaline earth alkylsalicylate detergent.

18. The method of claim 17, wherein the alkaline earth alkylsalicylate detergent is a calcium salicylate detergent.

19. The method of claim 18, wherein the calcium salicylate detergent has a TBN, as defined in ASTM D2896, of 50 to 450 mg KOH/g.

20. The method of claim 19, wherein calcium salicylate detergent has a TBN, as defined in ASTM D2896, of 200 to 300 mg KOH/g.

21. The method of claim 1, wherein the copolymer (i)(c) has a hydrophilic/lipophilic balance (HLB) of at least 6.5.

22. The method of claim 21, wherein the copolymer (i)(c) has a hydrophilic/lipophilic balance (HLB) from 7 to 9.

23. A method of lubricating an automotive internal combustion engine during operation of the engine comprising:

(i) providing to a crankcase of the automotive internal combustion engine an automotive crankcase lubricating oil composition comprising or made by admixing:

(a) in excess of 50 mass % of an oil of lubricating viscosity;

(b) less than 50 mass % of at least one overbased metal detergent;

(c) less than 50 mass % of an oil-soluble block or graft co-polymer of at least one block A which is derived from a hydroxycarboxylic acid and at least one polyalkylene block B which is a residue of a polyalkylene glycol, the oil-soluble block or graft copolymer exhibiting at least one of the following:

the molecular weight of the polymeric block A is from 1000 to 2800 as measured by Gel Permeation Chromatography;

the number average molecular weight of the polymeric block B is from 500 to 4600 as measured by Gel Permeation Chromatography; and the number average molecular weight of the copolymer is from 3000 to 5000, as measured by Gel Permeation Chromatography; and (d) optionally, at least one further additive comprising a dispersant, an antioxidant, and/or an antiwear agent, wherein the automotive crankcase lubricating oil composition includes less than 0.10 mass % of a friction modifier which is a monoester of a $C_5$ to $C_{30}$ carboxylic acid and which is free of nitrogen;

(ii) providing a hydrocarbon fuel in the automotive internal combustion engine; and (iii) combusting the fuel in the automotive internal combustion engine, wherein:

the or each of the polymeric components A are derived from poly(12-hydroxystearic acid) chain-terminated with stearic acid, and the polymeric component B is derived from polyethylene glycol; or the oil-soluble block or graft copolymer in component (i)(c) has a general formula $(A\text{-}COO)_m\text{-}B$, wherein m is 1 or 2, wherein each polymeric component A has a molecular weight of at least 500 has the general structural formula (I)

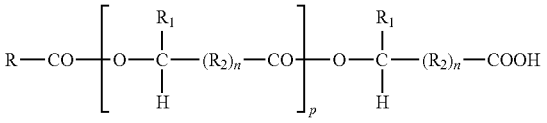

in which: R is hydrogen or a monovalent hydrocarbon or substituted hydrocarbon group: $R_1$ is hydrogen or a monovalent $C_1$ to $C_{24}$ hydrocarbon group; $R_2$ is a divalent $C_1$ to $C_{24}$ hydrocarbon group; n is zero or 1; and p is zero or an integer up to 200: and wherein each polymeric component B has a number average molecular weight of at least 500 and has the general formula (II)

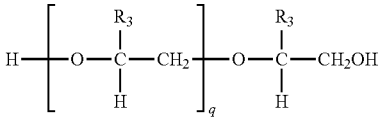

in which: $R_3$ is hydrogen or a $C_1$ to $C_3$ alkyl group; and q is an integer from 10 up to 500.

24. The method of claim 23, wherein the hydroxycarboxylic acid is a hydroxystearic acid.

25. The method of claim 23, wherein the polyalkylene glycol in component (i)(c) is polyethylene glycol.

26. The method of claim 23, wherein the copolymer in component (i)(c) has the structure AB or ABA, with the proviso that, where the block copolymer in component (i)(c) has the structure ABA, the A blocks may be the same or different.

27. The method of claim 23, wherein the friction modifier is glycerol monoester, and wherein the automotive crankcase lubricating oil composition comprising component (c) and less than 0.10 mass % of the glycerol monoester exhibits a lower friction coefficient than an otherwise identical automotive crankcase lubricating oil composition, except comprising substantially none of component (c) and more than 0.10 mass % of the glycerol monoester, when friction coefficients are measured at HFRR testing times greater than 751 seconds.

28. The method of claim 23, wherein the oft-soluble block or graft copolymer in component (i)(c) has a general formula $(A\text{-}COO)_m$-B, wherein m is 1 or 2, wherein each polymeric component A has a molecular weight of at least 500 has the general structural formula (I)

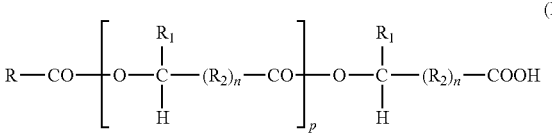

in which: R is hydrogen or a monovalent hydrocarbon or substituted hydrocarbon group; $R_1$ is hydrogen or a monovalent $C_1$ to $C_{24}$ hydrocarbon group; $R_2$ is a divalent $C_1$ to $C_{24}$ hydrocarbon group; n is zero or 1; and p is zero or an integer up to 200; and wherein each polymeric component B has a number average molecular weight of at least 500 and has the general formula (II)

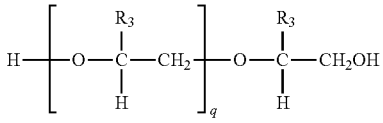

in which: $R_3$ is hydrogen or a $C_1$ to $C_3$ alkyl group; and q is an integer from 10 up to 500.

29. The method of claim 28, wherein R is an alkyl group containing up to 25 carbon atoms, $R_1$ is a straight-chain alkyl group containing 1 to 24 carbon atoms and $R_2$ is a straight-chain alkylene group containing 1 to 24 carbon atoms.

30. The method of claim 29, wherein $R_3$ is hydrogen or a $C_1$-$C_3$ alkyl group.

31. The method of claim 23, wherein the or each of the polymeric components A has a molecular weight of at least 1000 as measured by Gel Permeation Chromatography, and/or the polymeric component B has a number average molecular weight of at least 1000 as measured by Gel Permeation Chromatography.

32. The method of claim 23, wherein the or each of the polymeric components A are derived from poly(12-hydroxystearic acid) chain-terminated with stearic acid, and the polymeric component B is derived from polyethylene glycol.

33. The method of claim 23, wherein the automotive crankcase lubricating oil composition comprises not greater than 800 ppm by mass of phosphorus, expressed as phosphorus atoms.

34. The method of claim 33, wherein the automotive crankcase lubricating oil composition comprises not greater than 500 ppm by mass of phosphorus, expressed as phosphorus atoms.

35. The method of claim 23, wherein the automotive crankcase lubricating oil composition has a sulfated ash content of up to 1.0 and a sulfur content of up to 0.4 mass %.

36. The method of claim 23, further containing one or more other additive components, different from component (i)(c), selected from the group consisting of ashless dispersants, corrosion inhibitors, antioxidants, zinc dihydrocarbyl dithiophosphates, pour point depressants, antiwear agents, friction modifiers other than a monoester of a $C_5$ to $C_{30}$ carboxylic acid which is nitrogen-free, demulsifiers, and anti-foam agents.

37. The method of claim 23, wherein the overbased metal detergent is a metal hydroxybenzoate detergent.

38. The method of claim 37, wherein the metal hydroxybenzoate detergent is an alkaline earth alkylsalicylate detergent.

39. The method of claim 38, wherein the alkaline earth alkylsalicylate detergent is a calcium salicylate detergent.

40. The method of claim 39, wherein the calcium salicylate detergent has a TBN, as defined in ASTM D2896, of 50 to 450 mg KOH/g.

41. The method of claim 40, wherein calcium salicylate detergent has a TBN, as defined in ASTM D2896, of 200 to 300 mg KOH/g.

42. The method of claim 23, wherein the copolymer (i)(c) has a hydrophilic/lipophilic balance (HLB) of at least 6.5.

43. The method of claim 42, wherein the copolymer (i)(c) has a hydrophiliclipophilic balance (HLB) from 7 to 9.

44. A method of lubricating an automotive internal combustion engine during operation of the engine comprising:

providing to a crankcase of the automotive internal combustion engine an automotive crankcase lubricating oil composition comprising or made by admixing:

(a) in excess of 50 mass % of an oil of lubricating viscosity;

(b) less than 50 mass % of at least one overbased metal hydroxybenzoate detergent;

(c) less than 50 mass % of an oil-soluble block or graft copolymer of at least one block A which is derived from a hydroxycarboxylic acid and at least one polyalkylene block B which is a residue of a polyalkylene glycol; and (d) optionally, at least one further additive comprising a dispersant, an antioxidant, and/or an antiwear agent, wherein the automotive crankcase lubricating oil composition includes less than 0.10 mass % of a friction modifier which is a monoester of a $C_5$ to $C_{30}$ carboxylic acid and which is free of nitrogen;

(ii) providing a hydrocarbon fuel in the automotive internal combustion engine; and (iii) combusting the fuel in the automotive internal combustion engine, wherein the oil-soluble block or graft copolymer in component (i)(c) has a general formula $(A\text{-}COO)_m\text{-}B$, wherein m is 1 or 2, wherein each polymeric component A has a molecular weight of at least 500 has the general structural formula (I)

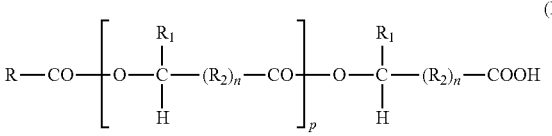

in which: R is hydrogen or a monovalent hydrocarbon or substituted hydrocarbon group; $R_1$ is hydrogen or a monovalent $C_1$ to $C_{24}$ hydrocarbon group; $R_2$ is a divalent $C_1$ to $C_{24}$ hydrocarbon group; n is zero or 1; and p is zero or an integer up to 200; and wherein each polymeric component B has a number average molecular weight of at least 500 and has the general formula (II)

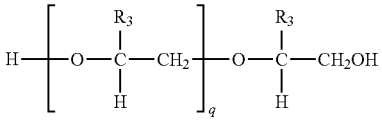

in which: $R_3$ is hydrogen or a $C_1$ to $C_3$ alkyl group; and q is an integer from 10 up to 500.

45. The method of claim 44, wherein the hydroxycarboxylic acid is a hydroxystearic acid and/or the polyalkylene glycol in component (i)(c) is polyethylene glycol.

46. The method of claim 44, wherein the friction modifier is glycerol monoester, and wherein the automotive crankcase lubricating oil composition comprising component (c) and less than 0.10 mass % of the glycerol monoester exhibits a lower friction coefficient than an otherwise identical automotive crankcase lubricating oil composition, except comprising substantially none of component (c) and more than 0.10 mass % of the glycerol monoester, when friction coefficients are measured at HFRR testing times greater than 751 seconds.

47. The method of claim 44, wherein R is an alkyl group containing up to 25 carbon atoms, $R_1$ is a straight-chain alkyl group containing 1 to 24 carbon atoms, $R_2$ is a straight-chain alkylene group containing 1 to 24 carbon atoms, and $R_3$ is hydrogen or a $C_1$-$C_3$ alkyl group.

48. The method of claim 44, wherein one or more of the following are satisfied:

the molecular weight of the polymeric block A in component (i)(c) is from 1000 to 2800 as measured by Gel Permeation Chromatography;

the number average molecular weight of the polymeric block B in component (i)(c) is from 500 to 4600 as measured by Gel Permeation Chromatography; and the number average molecular weight of the copolymer in component (i)(c) is from 3000 to 5000, as measured by Gel Permeation Chromatography.

49. The method of claim 44, wherein the automotive crankcase lubricating oil composition comprises not greater than 800 ppm by mass of phosphorus, expressed as phosphorus atoms.

50. The method of claim 49, wherein the automotive crankcase lubricating oil composition comprises not greater than 500 ppm by mass of phosphorus, expressed as phosphorus atoms.

51. The method of claim 44, wherein the automotive crankcase lubricating oil composition has a sulfated ash content of up to 1.0 and a sulfur content of up to 0.4 mass %.

52. The method of claim 44, further containing one or more other additive components, different from component (i)(c), selected from the group consisting of ashless dispersants, corrosion inhibitors, antioxidants, zinc dihydrocarbyl dithiophosphates, pour point depressants, antiwear agents, friction modifiers other than a monoester of a $C_5$ to $C_{30}$ carboxylic acid which is nitrogen-free, demulsifiers, and anti-foam agents.

53. The method of claim 44, wherein the metal hydroxybenzoate detergent is a calcium salicylate detergent.

54. The method of claim 53, wherein calcium salicylate detergent has a TBN, as defined in ASTM D2896, of 200 to 300 mg KOH/g.

55. The method of claim 44, wherein the copolymer (i)(c) has a hydrophilic lipophilic balance (HLB) from 7 to 9.

* * * * *